US006119478A

United States Patent [19]

Sada et al.

[11] Patent Number: 6,119,478

[45] Date of Patent: Sep. 19, 2000

[54] REFRIGERATION APPARATUS AND METHOD OF MANUFACTURING SAME

[75] Inventors: Shinri Sada; Osamu Tanaka, both of Osaka, Japan

[73] Assignee: Daikin Industries, Ltd., Osaka, Japan

[21] Appl. No.: 09/125,115

[22] PCT Filed: Dec. 25, 1997

[86] PCT No.: PCT/JP97/04865

§ 371 Date: Aug. 18, 1998

§ 102(e) Date: Aug. 18, 1998

[87] PCT Pub. No.: WO98/29699

PCT Pub. Date: Jul. 9, 1998

[30] Foreign Application Priority Data

Dec. 27, 1996 [JP] Japan ..... 8-350698

[51] Int. Cl.[7] ..... F25D 17/62

[52] U.S. Cl. ..... 62/434

[58] Field of Search ..... 62/333, 434, 430, 62/324.1

[56] References Cited

U.S. PATENT DOCUMENTS

| | | | |
|---|---|---|---|
| 2,779,171 | 1/1957 | Lindenblad | 62/434 |
| 2,893,218 | 7/1959 | Harnish | 62/434 |
| 3,881,323 | 5/1975 | Porter | 62/216 |
| 4,843,832 | 7/1989 | Yamada et al. | 62/159 |
| 5,607,013 | 3/1997 | Inoue et al. | 165/207 |
| 5,784,893 | 7/1998 | Furuhama et al. | 62/333 |

FOREIGN PATENT DOCUMENTS

| | | |
|---|---|---|
| 63-58062 | 3/1988 | Japan . |
| 7-269964 | 10/1995 | Japan . |
| 7-301433 | 11/1995 | Japan . |

*Primary Examiner*—William Doerrler

*Attorney, Agent, or Firm*—Nixon Peabody LLP; Donald R. Studebaker

[57] ABSTRACT

All components of an existing R22 refrigeration apparatus, exclusive of an indoor unit (A) and an existing line (21*b*), are removed. A refrigerant—refrigerant heat exchanger (2) and a refrigerant pump (23) are connected to the existing line (21*b*) to form a secondary refrigerant circuit (20). The R—R heat exchanger (2) is connected to a primary refrigerant circuit (10). Both the circuits (10) and (20) are charged with an R407C refrigerant. It is arranged such that the design pressure of the primary line (11) exceeds that of a secondary line (21) which was designed for a R22 refrigerant.

4 Claims, 4 Drawing Sheets

REFRIGERATION APPARATUS AND METHOD OF MANUFACTURING SAME

TECHNICAL FIELD

The present invention relates to a refrigeration apparatus operable to transfer heat between two refrigerant circuits and to a method of manufacturing such a refrigeration apparatus.

BACKGROUND ART

Compression heat pumps, which employ an HCFC-family refrigerant such as an R22 refrigerant, have been used widely in refrigeration apparatus of air conditioning systems or the like. Such a refrigeration apparatus has a refrigerant circuit formed of a combination of a compressor, a heat source side heat exchanger, an expansion valve, and a use side heat exchanger that are connected together by refrigerant piping.

In recent years, there have been strong demands for air conditioning (cooling and heating), especially for large-scale air conditioning systems for office buildings or the like (hereinafter referred to as the building air conditioning system). A typical building air conditioning system usually comprises a single outdoor unit and a plurality of indoor units installed in individual rooms of a building. The outdoor unit and the indoor units are linked together by refrigerant lines (piping) that extend from the outdoor unit to every room throughout the building.

Recently, a great concern has developed for global environmental protection, requesting environmentally friendly refrigerants (e.g., HFC-family refrigerants) be utilized as a replacement refrigerant for a currently used refrigerant of the HCFC family (e.g., an R22 refrigerant). This will give rise to the necessity of replacing a currently used refrigerant with an environmentally friendly refrigerant in building air conditioning systems.

In cases where HFC-family refrigerants are utilized, a synthetic oil, such as ester oil and ether oil, is employed as a refrigeration oil. These synthetic oils compare poorly in stability with a mineral oil conventionally used in an HCFC refrigeration apparatus, so that it is likely that a sludge-like solid material (contamination) is deposited. The use of an ester or ether oil therefore requires severe moisture and contamination control.

A large-scale building air conditioning system requires extensive refrigerant piping work because it is necessary to arrange a great number of refrigerant lines from the outside to each room of the building. Such piping work is time and cost consuming. If the existing refrigerant piping can be reused when replacing HCFC with HFC, this favorably achieves reductions in construction cost and time in comparison with cases where a new air conditioning system is constructed. PROBLEMS TO BE SOLVED In the case an existing refrigerant circuit is reused, replacing an HCFC-family refrigerant with an HCF-family refrigerant in the foregoing refrigeration apparatus produces the following problems.

Large-scale building air conditioning requires lengthy refrigerant piping. Therefore, moisture and contamination should be controlled extremely severely over a wide range. The exertion of such control is very difficult.

The existing refrigerant piping requires a thorough cleaning. This is considerably time and cost consuming.

In some cases, a refrigeration oil, used as a compressor lubricating oil, is deposited on the inside wall of a refrigerant line. When replacing a refrigerant of one type in a refrigerant circuit with a refrigerant of a different type, it will become necessary to thoroughly clean each refrigerant line.

Conventional HCFC refrigeration apparatus use a mineral oil as a refrigeration oil. On the other hand, an HFC refrigeration apparatus uses a synthetic oil (e.g., an ester oil and ether oil) as a refrigeration oil. These synthetic oils compare poorly in stability with a mineral oil, and a contamination is deposited when mixed with a mineral oil. This means that a slight amount of mineral oil left in a refrigerant line results in deposition of a contamination, therefore exerting undesirable effects on the refrigeration operation. In the case an HCFC-family refrigerant is replaced by an HFC-family refrigerant, the refrigerant lines must be thoroughly cleaned.

Complete removal of a mineral oil from in a refrigerant line by cleaning (flushing) is considerably time and cost consuming.

Another problem resulting from the exchange of a currently used refrigerant for the new environmentally safe refrigerant is the compressive strength of existing refrigerant lines, since their compressive strength is usually insufficient for the new refrigerant to replace with the old one. The refrigerant line design pressure is 28 kg/cm$^2$ for the R22 refrigerant which is an HCFC-family refrigerant. On the other hand, it is 34 kg/cm$^2$ for the R407C refrigerant which is an HFC-family refrigerant. The introducing of an R407C refrigerant into the existing refrigeration apparatus may produce the problem that the existing refrigerant piping is poor in pressure resistance. It is therefore impossible to compress the refrigerant to a region of specified high pressure level. If the refrigerant is compressed to such a high level, the refrigeration apparatus is not operationally safe.

It has been considered that it is difficult for the existing HCFC refrigerant piping to be reused for an HFC refrigeration apparatus.

Bearing in mind the above-described difficulty resulting from reusing the existing HCFC refrigerant piping for an HFC refrigeration apparatus, the present invention was made. Accordingly, an object of the present invention is to eliminate the necessity of exerting extremely severe moisture and contamination control which has been conventionally required when using HFC-family refrigerants. Another object of the present invention is to make it possible to reuse the existing refrigerant piping.

DISCLOSURE OF INVENTION

In order to achieve the above-described objects, an existing line (21*b*) is utilized in the present invention. Additionally, a secondary refrigerant circuit (20) which does not use a compressor that requires a refrigeration oil and a primary refrigerant circuit (10) which exchanges heat with the secondary refrigerant circuit (20) are provided.

A first solving means of the present invention comprises:

(a) a primary refrigerant circuit (10) which is formed of a combination of a compressor (13), a heat source side heat exchanger (12), decompression means (15), and a primary side (2*a*) of a refrigerant-refrigerant (R—R) heat exchanger (2) that are connected together by a primary line (11);

(b) a secondary refrigerant circuit (20) which is formed of a combination of a secondary side (2*b*) of said R—R heat exchanger (2) and a use side heat exchanger (22) that are connected together by a secondary line (21);

(c) refrigerant carrying means (M) for refrigerant circulation through said secondary refrigerant circuit (20); and (d) a secondary side refrigerant which is an HFC-family refrigerant, an HC-family refrigerant, or an FC-family refrigerant, said secondary side refrigerant being charged into at least said secondary refrigerant circuit (20).

An aspect of the first solving means of the present invention is as follows. The first solving means is advantageous in that the refrigeration apparatus of the first solving means has no need for exertion of extremely severe moisture/contamination control, since the refrigerant carrying means (M) that does not require any refrigeration oil is used in the secondary refrigerant circuit (20) which extends lengthily. This produces an improvement in the refrigeration apparatus reliability.

In addition to the above-described advantage, the first solving means can allow the existing refrigerant piping of an existing refrigeration apparatus running on an HCFC-family refrigerant to be reused when changing to an environmentally friendly alternative such as an HFC-family refrigerant. This provides reductions in construction cost and is time saving.

A second solving means of the present invention comprises:

(a) a primary refrigerant circuit (10) which is formed of a combination of a compressor (13), a heat source side heat exchanger (12), decompression means (15), and a primary side (2*a*) of a refrigerant-refrigerant (R—R) heat exchanger (2) that are connected together by a primary line (11);

(b) connection means (7) for forming a secondary refrigerant circuit (20) by including a part of a secondary line (21) of said secondary refrigerant circuit (20); said secondary refrigerant circuit (20) being connected to a secondary side (2*b*) of said R—R heat exchanger (2);

said secondary refrigerant circuit (20) being formed of a combination of said secondary side (2*b*) and a use side heat exchanger (22) that are connected together by said secondary line (21);

said secondary refrigerant circuit (20) being charged with a secondary side refrigerant which is an HFC-family refrigerant, an HC-family refrigerant, or an FC-family refrigerant; and (c) refrigerant carrying means (M) for circulating said secondary side refrigerant through said secondary refrigerant circuit (20).

In accordance with the second solving means of the present invention, the connecting means (7) is connected to the existing refrigerant line of the existing refrigeration apparatus running on an HCFC-family refrigerant. Such connection constitutes the secondary refrigerant circuit (20). In other words, the second solving means of the present invention implements an HFC refrigerant circuit while reusing the existing refrigerant line.

The present invention provides a third solving means according to the first or second solving means, wherein said refrigerant carrying means (M) is formed so as not to require a refrigeration oil.

An aspect of the third solving means of the present invention is as follows. The third solving means of the present invention is advantageous in that it has no need for exerting moisture/contamination control on the secondary refrigerant circuit (7).

The present invention provides a fourth solving means according to the third solving means, wherein said refrigerant carrying means (M) is formed so as to suck in and send out said secondary side refrigerant in the liquid phase for circulation of said secondary side refrigerant.

An aspect of the fourth solving means of the present invention is as follows. In accordance with the fourth solving means of the present invention, the refrigerant carrying means (M) applies travelling force to a liquid-phase secondary side refrigerant. The performance of the refrigerant carrying means (M) becomes lower in comparison with cases where the refrigerant carrying means (M) applies travelling force to a gas-phase secondary side refrigerant.

The present invention provides a fifth solving means according to the first or second solving means, wherein said primary line (11) is greater in allowable pressure than said secondary line (21).

An aspect of the fifth solving means of the present invention is as follows. In accordance with the fifth solving means of the present invention, the old (existing) line, which was designed to conform to specifications of an HCFC-family refrigerant, can be recycled as the secondary line (21). Even in the case no existing line is reused, the secondary line (21) can be reduced in size (thickness), thereby achieving a reduction in the material cost.

The present invention provides a sixth solving means according to claim 5, wherein said primary refrigerant circuit (10) is charged with a primary side refrigerant of the same type as said secondary side refrigerant charged in said secondary refrigerant circuit (20).

An aspect of the sixth solving means of the present invention is as follows. In accordance with the sixth solving means of the present invention, the same type of refrigerant is used throughout the air conditioning system, thereby simplifying the system structure.

The present invention provides a seventh solving means according to the fourth solving means, wherein said refrigerant carrying means (M) is formed such that said secondary side refrigerant in the gas phase in said secondary refrigerant circuit (20) is cooled to condense thereby creating a low pressure while said secondary side refrigerant in the liquid phase in said secondary refrigerant circuit (20) is heated to vaporize thereby creating a high pressure, for circulation of said secondary side refrigerant by said created low and high pressures.

An aspect of the seventh solving means of the present invention is as follows. In accordance with the seventh solving means of the present invention, travelling force is created in the secondary side refrigerant by the action of condensation and vaporization of the secondary side refrigerant, thereby allowing the refrigerant carrying means (M) to circulate the secondary side refrigerant without the aid of a refrigerant pump.

The present invention provides an eighth solving means according to the seventh solving means, wherein:

(a) said primary refrigerant circuit (10) is formed so as to be reversible in refrigerant circulation direction;

(b) said secondary line (21) includes a gas conduit (41) which links the upper portion of said R—R heat exchanger (2) to one of ends of said use side heat exchanger (22) and a liquid conduit (42) which links the lower portion of said R—R heat exchanger (2) to the other end of said use side heat exchanger (22); and (c) said refrigerant carrying means (M) has:

first opening/closing means (43) for opening and closing said gas conduit (41);

second opening/closing means (44) for opening and closing said liquid conduit (42); and transmission controlling means (50) for controlling said first and second opening/closing means (43) and (44) to open and close in alternation so that when one of said means (43) and (44) is in the open state, the other means is in the closed state, and for carrying said secondary side refrigerant by changing the circulation direction of a primary side refrigerant in said primary refrigerant circuit (10) so that a secondary side refrigerant in said R—R heat exchanger (2) is heated or cooled by said primary side refrigerant and by creating a difference in pressure between said secondary side refrigerant in said R—R heat exchanger (2) and a secondary side refrigerant in said use side heat exchanger (22).

An aspect of the eighth solving means of the present invention is as follows. In accordance with the eighth solving means of the present invention, high and low pressures are created in the secondary side refrigerant in the R—R heat exchanger (2) for circulating the secondary side refrigerant, which makes it possible to circulate the secondary side refrigerant without having to provide a mechanical drive source such as a pump to the secondary refrigerant circuit (20). It becomes possible to enhance refrigeration performance and the system reliability improves.

The present invention provides a ninth solving means which relates to a method of manufacturing a refrigeration apparatus. The method of the ninth solving means of the present invention comprises the steps of:

(a) removing the old refrigerant from an existing refrigerant circuit formed of a combination of a compressor (33), a heat source side heat exchanger (31), decompression means (35), and a use side heat exchanger (22) that are connected together by refrigerant lines (21*a*) and (21*b*);

(b) removing said compressor (33) and said heat exchanger (31) from said existing refrigerant circuit;

(c) linking to a remaining part (20A) of said existing refrigerant circuit a secondary side (2*b*) of a refrigerant-refrigerant (R—R) heat exchanger (2) in a primary refrigerant circuit (10) which is prepared by connecting together a compressor (13), a heat source side heat exchanger (12), said decompressor (35), and a primary side (2*a*) of said R—R heat exchanger (2), to form a secondary refrigerant circuit (20) from said remaining part (20A) and said secondary side (2*b*) of said R—R heat exchanger (2); and (d) charging said secondary refrigerant circuit (20) with a secondary side refrigerant which is an HFC-family refrigerant, an HC-family refrigerant, or an FC-family refrigerant.

An aspect of the ninth solving means of the present invention is as follows. In accordance with the ninth solving means of the present invention, the existing refrigerant line is reused, thereby making it possible to install a refrigerant line for an HFC-family refrigerant in a short period of time.

The present invention provides a tenth solving means which relates to a method of manufacturing a refrigeration apparatus. The method of the tenth solving means of the present invention comprises the steps of:

(a) removing the old refrigerant from an existing refrigerant circuit formed of a combination of a heat source side unit (D) and a use side unit (B) that are connected together by an existing refrigerant line (21*b*);

(b) removing said units (D) and (B) from said existing refrigerant circuit, leaving said existing refrigerant line (21*b*) between said units (D) and (B);

(c) linking to one of ends of a remaining part of said existing refrigerant line (21*b*) a secondary side (2*b*) of a refrigerant-refrigerant (R—R) heat exchanger (2) in a primary refrigerant circuit (10) which is prepared by connecting together a compressor (13), a heat source side heat exchanger (12), said decompressor (35), and a primary side (2*a*) of said R—R heat exchanger (2), and linking to the other end of said remaining part of said existing refrigerant line (21*b*) a new use side unit (B), to form a secondary refrigerant circuit (20) from said remaining part of said existing refrigerant line (21*b*), said secondary side (2*b*) of said R—R heat exchanger (2), and said new use side unit (B); and (d) charging said secondary refrigerant circuit (20) with a secondary side refrigerant which is an HFC-family refrigerant, an HC-family refrigerant, or an FC-family refrigerant.

An aspect of the tenth solving means of the present invention is as follows. In accordance with the tenth solving means of the present invention, only the existing refrigerant line is reused and the use side unit (B) with a capacity suitable for a heat load applied is installed.

The present invention provides an eleventh solving means according to the ninth or tenth solving means, wherein said primary line (11) is greater in allowable pressure than said secondary line (21).

An aspect of the eleventh solving means of the present invention is as follows. In accordance with the eleventh solving means of the present invention, the old (existing) line, which was designed to conform to specifications of an HCFC-family refrigerant, can be recycled as the secondary line (21) to form an environmentally friendly refrigeration apparatus.

The present invention provides a twelfth solving means according to the eleventh solving means, wherein said primary refrigerant circuit (10) is charged with a primary side refrigerant of the same type as said secondary side refrigerant in said secondary refrigerant circuit (20).

An aspect of the twelfth solving means of the present invention is as follows. In accordance with the twelfth solving means of the present invention, the same type of refrigerant is used throughout the air conditioning system, thereby simplifying the system structure.

EFFECTS OF THE INVENTION

The present invention provides the following effects.

The effects of the first and second solving means of the present invention are discussed. In the first and second solving means, the primary refrigerant circuit (10) which is relatively short in length and the secondary refrigerant circuit (20) which is relatively long in length are constructed and it is possible to provide the refrigerant carrying means (M) (which requires no refrigeration oil) in the secondary refrigerant circuit (20) that occupies most of the system piping length. Such arrangement eliminates the need for exertion of extremely sever moisture/contamination control. This achieves an improvement in the system reliability.

In addition to the above, the existing piping of an existing refrigeration apparatus running on an HCFC-family refrigerant can be reused for an HFC-family refrigerant. This achieves reductions in system production cost as well as in system construction time.

The effects of the third solving means of the present invention are discussed. In the third solving means, the refrigerant carrying means (M) uses no refrigeration oil, therefore preventing a synthetic oil from being mixed with a refrigeration oil such as a mineral oil. This eliminates the need for exertion of moisture/contamination control.

In addition to the above, it is unnecessary to remove a residual refrigeration oil in the second line (21). The second line (21) can be cleaned easily in a short time. This is cost saving.

The effects of the fourth solving means of the present invention are discussed. In the fourth solving means, the refrigerant carrying means (M) applies a travelling force to the secondary side refrigerant in the liquid phase. The performance of the refrigerant carrying means (M) becomes lower in comparison with cases where the refrigerant carrying means (M) applies a travelling force to the secondary side refrigerant in the gas phase.

The effects of the fifth solving means of the present invention are discussed. In the fifth solving means, the old (existing) line, which was designed to conform to specifications of an HCFC-family refrigerant, can be recycled as the secondary line (21).

Additionally in the case not only the primary line (11) but also the secondary line (21) are newly installed, it is possible to reduce the thickness of the secondary line (21) therefore achieving a reduction of the material cost.

The effects of the sixth solving means of the present invention are discussed. In the sixth solving means, the primary and secondary refrigerant circuits (10) and (20) use the same HFC-family refrigerant therefore simplifying the entire system structure.

The effects of the seventh solving means of the present invention are discussed. In the seventh solving means, the refrigerant carrying means (M) creates low and high pressures in the secondary side refrigerant, thereby making it possible to circulate the secondary side refrigerant without having to provide any mechanical driving source such as a pump to the secondary refrigerant circuit (20). This is power saving. The air conditioning system (6) is therefore energy saving.

In addition to the above, the number of factors that cause a system failure and the number of components that may fail to operate normally can be reduced in the seventh solving means. This improves the entire system reliability.

Additionally, since low and high pressures are created in the secondary side refrigerant, the limit of equipment installation layout becomes less strict, thereby achieving high reliability and flexibility.

The endoergic and heat radiating operations of the secondary refrigerant circuit (20) can be performed in stable manner. Even when the secondary refrigerant circuit (20) is large in size, refrigerant circulation can be carried out adequately. Even for the case of large-scale existing piping, sufficient performance can be obtained.

The effects of the eighth solving means of the present invention are discussed. In the eighth solving means, low and high pressures are created in the secondary side refrigerant in the R—R heat exchanger (2). This simplifies not only the structure of the refrigerant carrying means (M) but also the structure of the secondary refrigerant circuit (20).

The effects of the ninth solving means of the present invention are discussed. In the ninth solving means, the existing piping can be used effectively. A refrigerant line, such as an HFC refrigerant line can be constructed in a short period of time.

The effects of the tenth solving means of the present invention are discussed. In the tenth solving means, the existing piping can be used effectively and it is possible to install an indoor unit with a capacity suitable for a refrigerant such as an HFC-family refrigerant and a heat load applied.

The effects of the eleventh solving means of the present invention are discussed. In the eleventh solving means, it is possible to build a refrigeration apparatus in which the existing piping, which was designed for an HCFC-family refrigerant, is reused in the secondary line (21).

The effects of the twelfth solving means of the present invention are discussed. In the twelfth solving means, the primary and secondary refrigerant circuits (10) and (20) use the same HFC-family refrigerant therefore making it possible to simplify the entire system structure.

BEST MODE FOR CARRYING OUT THE INVENTION

Preferred embodiments of the present invention will be described below with reference to the accompanying drawings.

FIRST EMBODIMENT

STRUCTURE

Figure 1:
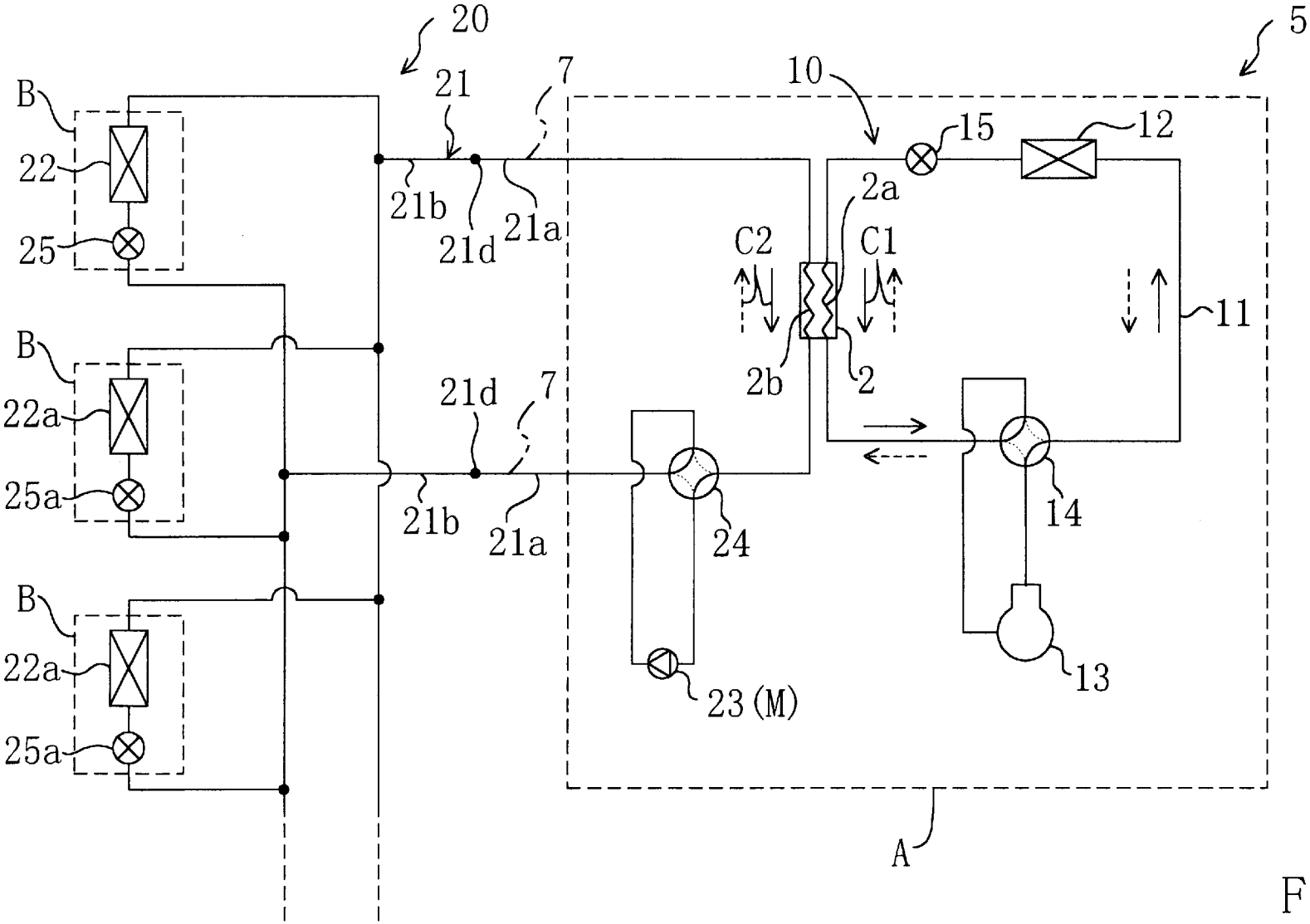
FIG. 1 is a refrigerant circuit diagram of an air conditioning system in accordance with a first embodiment of the present invention.

Referring first to FIG. 1, therein shown is an air conditioning system (5) of a first embodiment of the present invention. The air conditioning system (5) is a refrigeration apparatus comprising a single outdoor unit (A) and a plurality of indoor units (B). The refrigerant circuit of the air conditioning system (5) comprises a primary refrigerant circuit (10) and a secondary refrigerant circuit (20).

13 is a compressor. 14 is a four-way selector valve. 12 is an outdoor heat exchanger which is a heat source side heat exchanger. 15 is an electric expansion valve which is decompression means. 2 is a refrigerant—refrigerant (R—R) heat exchanger which has a primary side (2*a*). These components (13), (14), (12), (15), and (2*a*) are connected together by a primary line (11) to form the primary refrigerant circuit (10). The primary refrigerant circuit (10) is charged with an R407C refrigerant which is an HFC-family refrigerant as a primary side refrigerant. The dimensions of the primary line (11) are determined on the basis of the R407C design pressure (i.e., 34 kg/cm$^2$) so as not to be damaged until the inner pressure thereof goes beyond a specified allowable pressure (P1).

23 is a refrigerant pump as refrigerant carrying means (M). 24 is a four-way selector valve used to change a flow direction. 25 is a flow regulating valve formed by an electric expansion valve. 22 is an indoor heat exchanger as a use side heat exchanger. 2*b* is a secondary side of the R—R heat exchanger (2). These components (23), (24), (22), and the secondary side (2*b*) are connected together by a secondary line (21) to form the secondary refrigerant circuit (20). The flow regulating valve (25) and the indoor heat exchanger (22) are disposed in each indoor unit (B).

The indoor units (B) are connected in parallel with one another. The flow regulating valve (25) and the indoor heat exchanger (22) of one indoor unit (B) are connected by the secondary line (21) in parallel with the flow regulating valve (25) and the indoor heat exchanger (22) of the next indoor unit (B). The secondary refrigerant circuit (20) is charged with the same refrigerant as charged in the primary refrigerant circuit (10) as a secondary side refrigerant (i.e., an R407C refrigerant). The dimensions of the secondary line (21) are determined on the basis of the R22 design pressure (i.e., 28 kg/cm$^2$) so as not to be damaged until the inner pressure thereof goes beyond a specified allowable pressure (P2). The allowable pressure (P2) is lower than the allowable pressure (P1) of the primary line (11).

The primary refrigerant circuit (10), the R—R heat exchanger (2), the four-way selector valve (24), and the refrigerant pump (23) are disposed in the outdoor unit (A). The outdoor unit (A) and the indoor units (B) are connected together by the secondary line (21).

MANUFACTURING METHOD

A method of manufacturing the air conditioning system (5) of the present invention is now described below. The secondary refrigerant circuit (20) of the air conditioning system (5) is constituted by reusing a part of an existing air conditioning system (36) shown in FIG. 2. The existing air conditioning system (36) is a system employing an R22 refrigerant.

Figure 2:
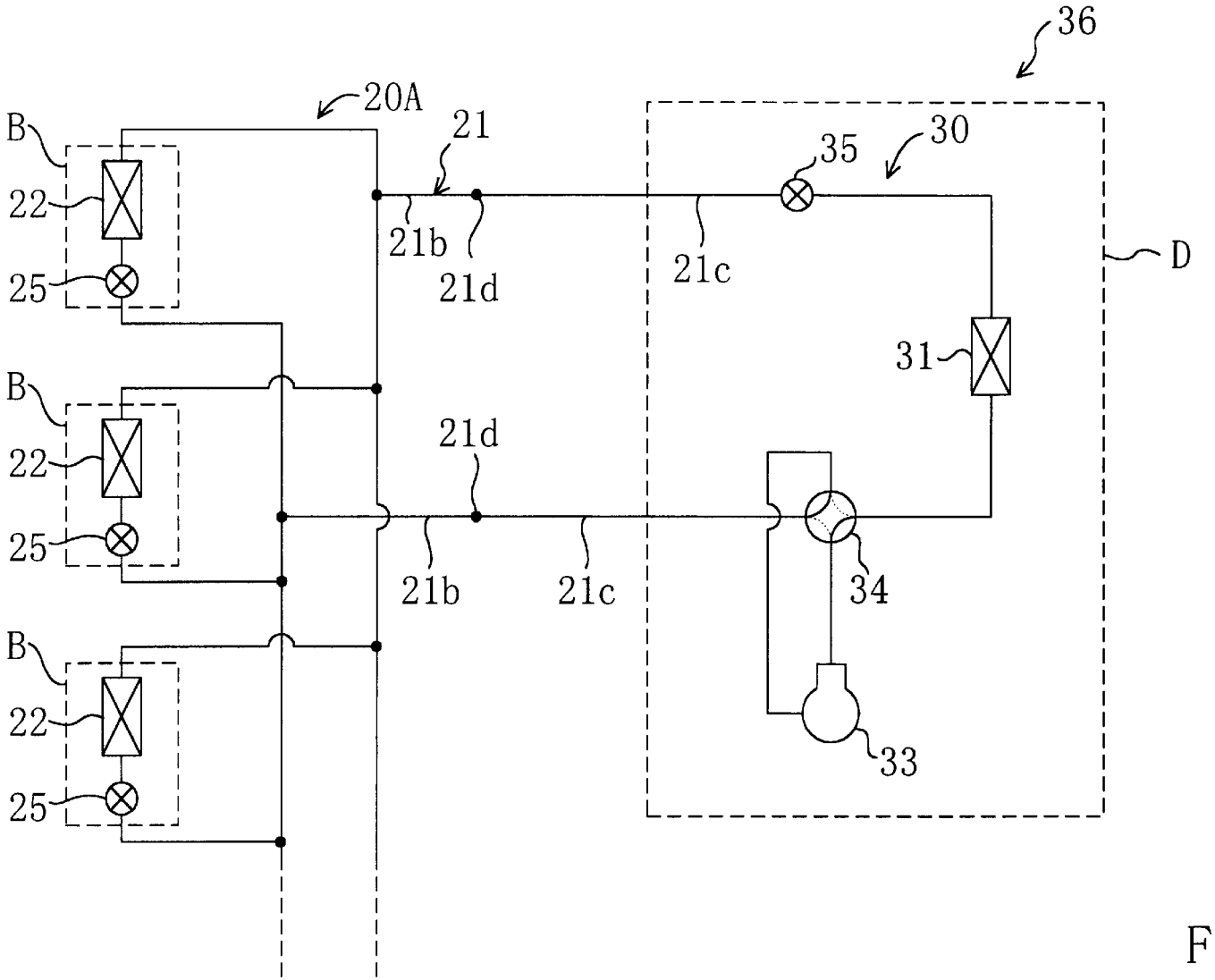
FIG. 2 is a refrigerant circuit diagram of an existing air conditioning system.

The secondary refrigerant circuit (20) of FIG. 1 without the refrigerant pump (23), the four-way selector valve (24) and the R—R heat exchanger (2) forms a reuse circuit (20A) which is a part of the existing air conditioning system (36) of FIG. 2.

As mentioned above, the existing air conditioning system (36) was designed to run on an R22 refrigerant. As shown in FIG. 2, the air conditioning system (36) comprises an outdoor unit (D) which is a heat source side unit and a plurality of indoor units (B) which are use side units. The outdoor unit (D) has a heat source side circuit (30). The heat source side circuit (30) is formed of a combination of a compressor (33), a four-way selector valve (34), an outdoor heat exchanger (31), and an electric expansion valve (35) that are connected together by a refrigerant line (21*c*).

The reuse circuit (20A) is reused so as to serve as the secondary refrigerant circuit (20) of the new air conditioning system (5). The refrigerant line (21*b*) is connected to each indoor unit (B) to form the reuse circuit (20A). The reuse circuit (20A) is connected to the heat source side circuit (30) by the refrigerant line (21*b*).

The refrigerant piping of the existing air conditioning system (36), which includes the refrigerant line (21*c*) of the heat source side circuit (30), the refrigerant line (21*b*) of the reuse circuit (20A), the flow regulating valve (25), and the indoor heat exchanger (22), is constituted on the basis of the R22 design pressure (i.e., 28 kg/cm$^2$). The refrigerant lines (21*c*) and (21*b*), the flow regulating valve (25), and the indoor heat exchanger (22) are designed so as not to be damaged until the allowable pressure (P1) is reached.

The air conditioning system (5) that is newly installed is built as follows. The old R-22 refrigerant is first removed from the refrigerant circuit of the existing air conditioning system (36). The refrigerant line (21*b*), which is connecting together the heat source side circuit (30) and the reuse circuit (20A), is cut at a cutting position (21*d*). The circuit (30) is discarded.

Thereafter, the refrigerant line (21*b*) in the reuse circuit (20A), the flow regulating valve (25), and the indoor heat exchanger (22) are cleaned.

After the foregoing cleaning step is completed, the outdoor unit (A) having the primary refrigerant circuit (10) is installed (the outdoor unit (A) has been completed, quality-controlled in the factory, and carried to the installation site).

After the step of installing the outdoor unit (A) is completed, the refrigerant line (21*a*) extending from the outdoor unit (A) is joined to the refrigerant line (21*b*) in the reuse circuit (20A) at the cutting position (21*d*). The piping work of the secondary refrigerant circuit (20) is now completed by such connection.

Thereafter, the secondary refrigerant circuit (20) is examined for airtightness. The secondary refrigerant circuit (20) is charged with a specified amount of R407C. The air conditioning system (5) is now completed.

In the present embodiment, the refrigerant line (21*b*) in the reuse circuit (20A), the flow regulating valve (25), and the indoor heat exchanger (22) are subjected to cleaning. Such cleaning can be a simple one and can be omitted. In other words, the secondary refrigerant circuit (20) requires no refrigeration oil and there is no need for removing a refrigeration oil.

DESIGN PRESSURE

The design pressure of the primary and secondary lines (11) and (21) in the air conditioning system (5) of the present embodiment is described below.

When the air conditioning system (5) performs cooling operation in the overload state, a maximum pressure, for example 34 kg/cm$^2$, is applied to the primary line (11) and the design pressure of the primary line (11) is therefore determined on the basis of the maximum pressure (34 kg/cm$^2$). The saturation temperature of the R407C refrigerant for a pressure of 34 kg/cm$^2$ is about 70 degrees centigrade.

When the air conditioning system (5) performs heating operation, a maximum pressure is applied to the secondary line (21). It can be considered that the condensation temperature at the time of such heating operation is at a temperature in the range from about 40 degrees centigrade to about 50 degrees centigrade. A saturation pressure for such a condensation temperature (i.e., from about 17 kg/cm$^2$ to abut 22 kg/cm$^2$) is applied to the secondary line (21). Accordingly, the maximum pressure, which is applied to the secondary line (21), is about 22 kg/cm$^2$. Although the design pressure of the secondary line (21) in the air conditioning system (5) is determined at 28 kg/cm$^2$, any one of the existing refrigerant lines that has a design pressure in excess of the foregoing maximum pressure (22 kg/cm$^2$) can be reused as the secondary line (21).

In accordance with the air conditioning system (5) of the present embodiment, it is arranged such that the design pressure of the secondary line (21) falls below that of the primary line (11).

OPERATION

The operations of the air conditioning system (5) are described below.

COOLING

The cooling operation of the air conditioning system (5) is explained. In the cooling operation, the four-way selector valve (14) of the primary refrigerant circuit (10) is switched such that the primary refrigerant (C1) flows in the direction as indicated by the solid-line arrows of FIG. 1. Likewise, the four-way selector valve (24) of the secondary refrigerant circuit (20) is switched such that the secondary side refrigerant (C2) flows in the direction as indicated by the solid-line arrows of FIG. 1.

In the primary refrigerant circuit (10), a high-pressure primary side refrigerant (C1) is discharged from the compressor (13), passes through the four-way selector valve (14), and flows in the outdoor heat exchanger (12) as shown by the solid-line arrows of FIG. 1. The primary side refrigerant (C1) is condensed in the outdoor heat exchanger (12), decompressed in the electric expansion valve (15) to expand, and becomes a low-temperature two-phase refrigerant. This two-phase refrigerant (C1) flows through the primary side (2*a*) of the R—R heat exchanger (2). In the R—R heat exchanger (2), the primary side refrigerant (C1) exchanges heat with the secondary side refrigerant (C2) which flows in the secondary refrigerant circuit (20) and is therefore vaporized, at which time the secondary side refrigerant (C2) is cooled by the primary side refrigerant (C1). Thereafter, the vaporized primary side refrigerant (C1) passes through the four-way selector valve (14) and returns to the compressor (13). The primary side refrigerant (C1) is compressed again and discharged to repeat the circulation cycle.

In the secondary refrigerant circuit (20), the secondary side refrigerant (C2) in the liquid phase flows out of the refrigerant pump (23), passes through the four-way selector valve (24), and branches off to each indoor unit (B). The secondary side refrigerant (C2) enters the indoor unit (B), passes through the flow regulating valve (25), and flows in the indoor heat exchanger (22). The secondary side refrigerant (C2) is vaporized in the indoor heat exchanger (22) to cool room air. Thereafter, the vaporized secondary side refrigerant (C2) flows through the secondary line (21) and flows into the secondary side (2*b*) of the R—R heat exchanger (2). In the R—R heat exchanger (2), the secondary side refrigerant (C2) is cooled by the primary side refrigerant (C1) and condensed to become a liquid refrigerant. Passing through the secondary side (2*b*) of the R—R heat exchanger (2) and then through the four-way selector valve (24), this liquid-phase secondary side refrigerant (C2) flows into the refrigerant pump (23). The secondary side refrigerant (C2) is again delivered from the refrigerant pump 23 to repeat the circulation cycle.

The room, in which the indoor unit (B) is installed, is cooled.

HEATING

The heating operation of the air conditioning system (5) is explained. In the heating operation, the four-way selector valve (14) of the primary refrigerant circuit (10) is switched such that the primary refrigerant (C1) flows in the direction as indicated by the broken-line arrows of FIG. 1. Likewise, the four-way selector valve (24) of the secondary refrigerant circuit (20) is switched such that the second refrigerant (C2) flows in the direction as indicated by the broken-line arrows of FIG. 1.

In the primary refrigerant circuit (10), the high-pressure primary side refrigerant (C1) is discharged from the compressor (13), passes through the four-way selector valve (14), and flows through the primary side (2*a*) of the R—R heat exchanger (2) as shown by the broken-line arrows of FIG. 1. In the R—R heat exchanger (2), the primary side refrigerant (C1) exchanges heat with the secondary side refrigerant (C2) which flows through the secondary refrigerant circuit (20) and is therefore condensed, at which time the secondary side refrigerant (C2) is heated by the primary side refrigerant (C1). Thereafter, the condensed primary side refrigerant (C1) leaves the R—R heat exchanger (2), is decompressed in the electric expansion valve (15) to expand, and becomes a two-phase refrigerant. This two-phase primary side refrigerant (C1) is vaporized in the outdoor heat exchanger (12), passes through the four-way selector valve (14), and is brought back to the compressor (13). The primary side refrigerant (C1) is compressed again in the compressor (13) and delivered therefrom to repeat the circulation cycle.

In the secondary refrigerant circuit (20), the secondary side refrigerant (C2) is discharged from the refrigerant pump (23), passes through the four-way selector valve (24), and enters the secondary side (2*b*) of the R—R heat exchanger (2). In the R—R heat exchanger (2), the secondary side refrigerant (C2) is heated by the primary side refrigerant (C1) to be vaporized. Thereafter, the vaporized secondary side refrigerant (C2) passes through the secondary side (2*b*) of the R—R heat exchanger (2) and then through the secondary line (21) and branches off to each indoor unit (B). In each indoor unit (B), the secondary side refrigerant (C2) flows in the indoor heat exchanger (22). In the indoor heat exchanger (22), the secondary side refrigerant (C2) condenses thereby heating room air. Leaving the indoor heat exchanger (22), the condensed secondary side refrigerant (C2) passes through the flow regulating valve (25) to be regulated in flow rate. Thereafter, the secondary side refrigerant (C2) passes through the four-way selector valve (24) and flows into the refrigerant pump (23). The secondary side refrigerant (C2) is again discharged from the refrigerant pump 23 to repeat the circulation cycle. Each room, in which the indoor unit (B) is installed, is heated.

EFFECTS

In the air conditioning system (5) of the present embodiment, the compressor (13) which requires a refrigeration oil is disposed only in the primary refrigerant circuit (10) and no compressor is disposed in the secondary refrigerant circuit (20). Only the primary refrigerant circuit (10), which has relatively short piping, is subjected to severe moisture/contamination control. The moisture/contamination control of the secondary refrigerant circuit (20) with a relatively long piping length can be simplified. Throughout the air conditioning system (5), the moisture/contamination control can be carried out readily thereby improving system reliability.

In the secondary refrigerant circuit (20) which requires the execution of site works and on which it is difficult to exert severe moisture/contamination control, such severe control is no longer required. On the other hand, the primary refrigerant circuit (10) is prepared in the factory before its installation at the site, which makes it possible to subject the primary refrigerant circuit (10) to severe moisture/contamination control in the factory.

The existing line (21*b*) and the indoor heat exchanger (22) in the R22 air conditioning system (36) are reused as the R407C secondary line (21) and as the R407C indoor heat exchanger (22), respectively. This achieves not only a reduction in the work execution cost but also a reduction in the work execution time.

Since the secondary refrigerant circuit (20) is provided with no compressor, no refrigeration oil is required. This prevents a synthetic oil and a mineral oil from being mixed with each other, thereby making moisture/contamination control easy.

Even when a refrigeration oil such as a mineral oil remains in the secondary line (21), no contamination is deposited, therefore eliminating the need for removing the remaining refrigeration oil in the secondary line (21). As a result, cleaning the secondary line (21) can be carried out readily and smoothly. This achieves a reduction in the cleaning cost.

The primary and secondary refrigerant circuits (10) and (20) use the same HFC-family refrigerant, R407C. This simplifies the entire system structure.

The secondary side refrigerant (C2) in the liquid phase is given travelling force by the refrigerant pump (23), whereby the power of drive can be reduced in comparison with cases in which the secondary side refrigerant (C2) in the gas phase is given travelling force.

SECOND EMBODIMENT

Figure 3:
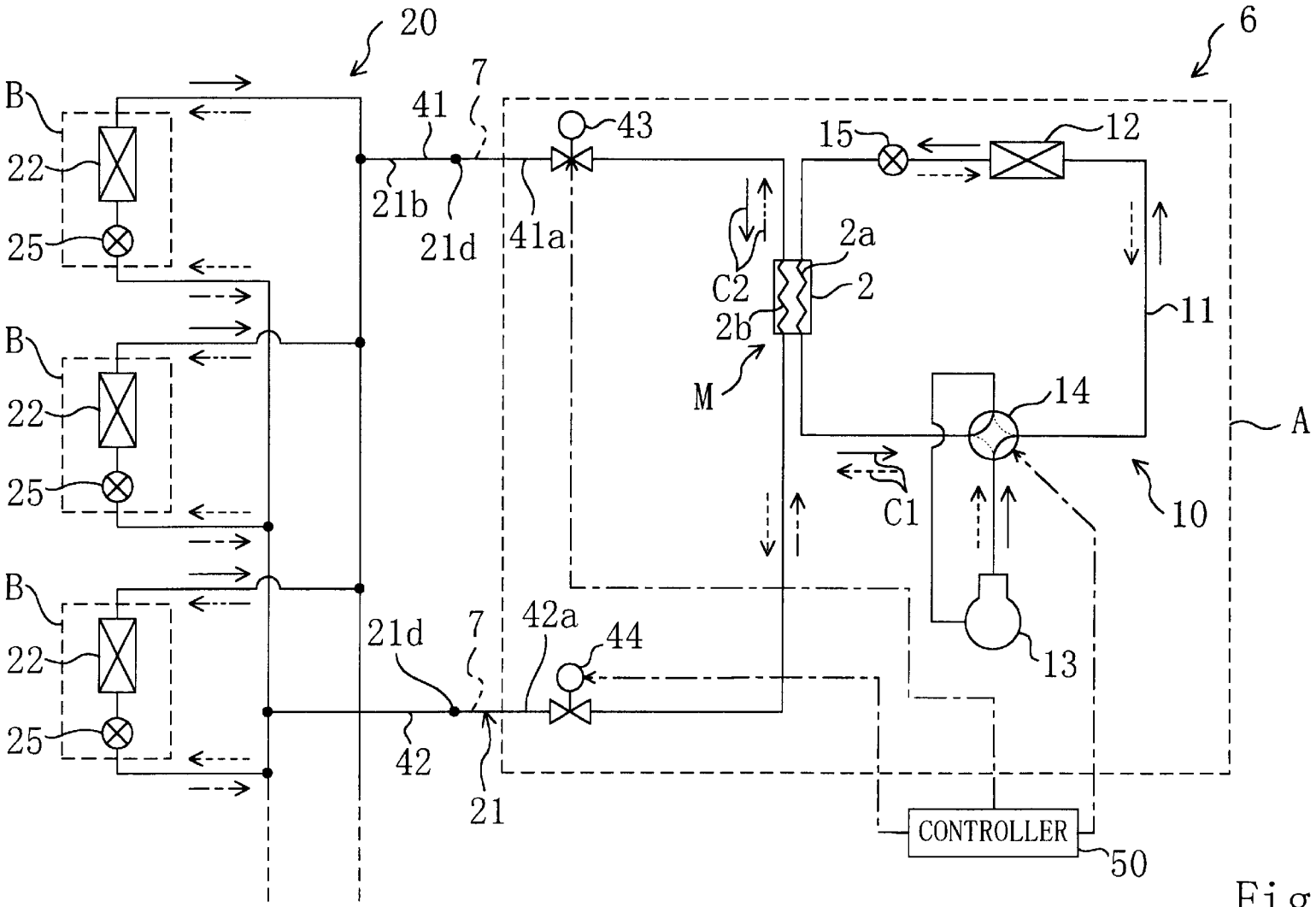
FIG. 3 is a refrigerant circuit diagram of an air conditioning system in accordance with a second embodiment of the present invention.

As shown in FIG. 3, the heat carrying unit (M) employs a so-called non-powered heat carrying method in an air conditioning system (6) of a second embodiment of the present invention.

STRUCTURE

The air conditioning system (6) of the second embodiment has a primary refrigerant circuit (10) which is identical in structure with the counterpart of the air conditioning system (5) of the first embodiment. Like reference numerals are used to represent like components and the description of these components is omitted.

The secondary refrigerant circuit (20) has a structure which is formed of a combination of the indoor heat exchanger (22), the flow regulating valve (25), and the R—R heat exchanger (2) that are connected together by the secondary line (21) made up of a gas conduit (41) and a liquid conduit (42). The flow regulating valve (25) and the indoor heat exchanger (22) are disposed in the indoor unit (B) and the R—R heat exchanger (2) is disposed in the outdoor unit (A).

The gas conduit (41) is connected to the upper end portion of the indoor heat exchanger (22) and to the upper end portion of the secondary side (2*b*) of the R—R heat exchanger (2). The gas conduit (41) is provided with a first electromagnetic valve (43).

On the other hand, the liquid conduit (42) is connected to the lower end portion of the indoor heat exchanger (22) and to the lower end portion of the secondary side (2*b*) of the R—R heat exchanger (2). The liquid conduit (42) is provided with a second electromagnetic valve (44).

Both the first and second electromagnetic valves (43) and (44) are disposed in the outdoor unit (A). The electromagnetic valves (43) and (44) constitute flow-way control means for the refrigerant carrying unit (M).

The refrigerant carrying means (M) has a controller (50) operable as transmission control means. The controller (50) is constructed so as to control the first and second electromagnetic valves (43) and (44) to open and close in alternate fashion. In other words, when one of the electromagnetic valves (43) and (44) is in the open state, the other electromagnetic valve is in the closed state. The controller (50) is constructed such that the secondary side refrigerant (C2) is made to travel by changing a circulation path of the primary side refrigerant (C1) in the primary refrigerant circuit (10), by heating or cooling the secondary side refrigerant (C2) in the R—R heat exchanger (2) with the primary side refrigerant (C1), and by creating a difference in pressure between the secondary side refrigerant (C2) in the R—R heat exchanger (2) and the secondary side refrigerant (C2) in the indoor heat exchanger (22).

In other words, the refrigerant carrying means (M) Is constructed such that (i) the gas-phase secondary side refrigerant (C2) in the secondary refrigerant circuit (20) is cooled in the R—R heat exchanger (2) and condensed, in consequence of which a low pressure is created, (ii) the liquid-phase secondary side refrigerant (C2) in the secondary refrigerant circuit (20) is heated in the R—R heat exchanger (2) and vaporized, In consequence of which a high pressure is created, and (iii) the secondary side refrigerant (C2) is circulated by the low and high pressures thus created.

MANUFACTURING METHOD

Also in the air conditioning system (6) formed according to the second embodiment of the present invention, the secondary refrigerant circuit (20) reuses a part of the existing air conditioning system (36) that ran on R22. A method of manufacturing the air conditioning system (6) is now described below.

Like the first embodiment, the heat source side circuit (30) of the existing air conditioning system (36) is removed. Thereafter, the refrigerant line (21*b*) in the reuse circuit (20A) of the existing air conditioning system (36) is cleaned, and the outdoor unit (A) having the primary refrigerant circuit (10), the first electromagnetic valve (43), and the second electromagnetic valve (44) is installed.

After the installation of the outdoor unit (A) is completed, a refrigerant line (41*a*) extending from the first electromagnetic valve (43) and a refrigerant line (42*a*) extending from the second electromagnetic valve (44) are joined to the reuse circuit (20A) at the cutting position (21*d*).

A specified airtightness test is performed on the secondary refrigerant circuit (20). Thereafter, the secondary refrigerant circuit (20) is charged with a specified amount of R407C refrigerant.

In the way described above, the air conditioning system (6) is completed.

OPERATION

The cooling and heating operations of the air conditioning system (6) are described separately.

COOLING

The cooling operation is first described. In the primary refrigerant circuit (10) the four-way selector valve (14) is switched such that the primary side refrigerant (C1) flows in the direction as indicated by the solid-line arrows of FIG. 3, and the opening of the electric expansion valve (15) is adjusted to a specified opening degree. On the other hand, in the secondary refrigerant circuit (20) the first electromagnetic valve (43) is open and the second electromagnetic valve (44) is closed.

In such a situation, the compressor (13) in the primary refrigerant circuit (10) is driven.

As shown by the solid-line arrows of FIG. 3, the primary side refrigerant (C1), which is a high-temperature, high-pressure gas refrigerant, is discharged from the compressor (13), passes through the four-way selector valve (14), and exchanges heat with outside air in the outdoor heat exchanger (12), in consequence of which the primary side refrigerant (C1) is condensed. Thereafter, the condensed primary side refrigerant (C1) is decompressed in the electric expansion valve (15) to expand and flows in the primary side (2*a*) of the R—R heat exchanger (2). In the R—R heat exchanger (2), the primary side refrigerant (C1) exchanges heat with the secondary side refrigerant (C2) which is flowing in the secondary refrigerant circuit (20), in other word, the primary side refrigerant (C1) extracts the heat from the secondary side refrigerant (C2), in consequence of which the primary side refrigerant (C1) is vaporized. Thereafter, the vaporized primary side refrigerant (C1) passes through the primary side (2*a*) of the R—R heat exchanger (2) and then through the four-way selector valve (14) to return to the compressor (13). The primary side refrigerant (C1) is compressed again in the compressor (13) and discharged therefrom to repeat the circulation cycle.

On the other hand, in the secondary refrigerant circuit (20) the secondary side refrigerant (C2) in the R—R heat exchanger (2) exchanges heat with the primary side refrigerant (C1) and is condensed, in consequence of which the secondary side (2*b*) of the R—R heat exchanger (2) undergoes a drop in refrigerant pressure. The indoor heat exchanger (22) comes to have a refrigerant pressure in excess of that of the R—R heat exchanger (2). Such a difference in refrigerant pressure between the heat exchangers (22) and (2) serves as driving force, and as shown by the solid-line arrows of FIG. 3, the secondary side refrigerant (C2) which is the gas phase in the indoor heat exchanger

(22) is withdrawn through the gas conduit (41) to the secondary side (2*b*) of the R—R heat exchanger (2). In the R—R heat exchanger (2), the gas-phase secondary side refrigerant (C2) is cooled by the primary side refrigerant (C1) to condense, becomes a liquid refrigerant, and is held at the secondary side (2*b*) of the R—R heat exchanger (2).

After the withdrawal of the secondary side refrigerant (C2), the primary and secondary refrigerant circuits (10) and (20) each switch to a refrigerant supply operation. That is, in the primary refrigerant circuit (10) the four-way selector valve (14) is switched so that the primary side refrigerant (C1) flows in the direction as indicated by the broken-line arrows and the opening of the electric expansion valve (15) is adjusted to a specified opening degree. In the secondary refrigerant circuit (20) the first electromagnetic valve (43) is closed and the second electromagnetic valve (44) is open.

In such a situation, the refrigerant supply operation is carried out. In the primary refrigerant circuit (10), as shown by the broken-line arrows of FIG. 3, the primary side refrigerant (C1), which is a high-temperature, high-pressure gas refrigerant, is discharged from the compressor (13), passes through the four-way selector valve (14), and flows into the primary side (2*a*) of the R—R heat exchanger (2). In the R—R heat exchanger (2), the primary side refrigerant (C1) exchanges heat with the secondary side refrigerant (C2) where the primary side refrigerant (C1) gives off the heat to the secondary side refrigerant (C2) and is condensed. Thereafter, leaving the primary side (2*a*) of the R—R heat exchanger (2), the condensed primary side refrigerant (C1) is decompressed in the electric expansion valve (15) to undergo expansion and flows through the outdoor heat exchanger (12). In the outdoor heat exchanger (12), the primary side refrigerant (C1) exchanges heat with outside air and is vaporized. Thereafter, the primary side refrigerant (C1) passes through the four-way selector valve (14) and is brought back to the compressor (13). The primary side refrigerant (C1) is compressed again in the compressor (13) and discharged therefrom to repeat the circulation cycle.

Meanwhile, in the secondary refrigerant circuit (20) the secondary side refrigerant (C2) in the R—R heat exchanger (2) is heated by the primary side refrigerant (C1), in consequence of which the secondary side (2*b*) of the R—R heat exchanger (2) undergoes an increase in refrigerant pressure and the refrigerant pressure of the R—R heat exchanger (2) exceeds that of the indoor heat exchanger (22). The resulting difference in refrigerant pressure created between the heat exchangers (2) and (22) serves as driving force, and as shown by the broken-line arrows of FIG. 3, the secondary side refrigerant (C2), which is in the liquid phase in the R—R heat exchanger (2), is forced to travel towards the indoor heat exchanger (22), via the lower portion of the R—R heat exchanger (2) and the liquid conduit (42). This liquid-phase secondary side refrigerant (C2) expelled from the R—R heat exchanger (2) passes through the flow regulating valve (25) and flows through the indoor heat exchanger (22). In the indoor heat exchanger (22), the second refrigerant (C2) exchanges heat with room air and is vaporized, whereby the room air is cooled.

After the foregoing refrigerant supply operation is carried out for a specified period of time, the primary and secondary refrigerant circuits (10) and (20) each switch from the refrigerant supply operation to the refrigerant is withdrawal operation. Thereafter, the supply operation and the withdrawal operation are carried out alternately, whereby the secondary side refrigerant (C2) is made to circulate in the secondary refrigerant circuit (20) and the room is cooled.

HEATING

The heating operation is now described. The four-way selector valve (14) is switched so that the primary side refrigerant (C1) flows in the direction as indicated by the solid-line arrow direction of FIG. 3 and the opening of the electric expansion valve (15) is adjusted to a specified opening degree in the primary refrigerant circuit (10). The first electromagnetic valve (43) is closed and the second electromagnetic valve (44) is open in the secondary refrigerant circuit (20).

In such a situation, the refrigerant withdrawal operation is carried out. In the primary refrigerant circuit (10), as shown by the solid-line arrows, the primary side refrigerant (C1), which is a gas refrigerant high in temperature and pressure, is discharged from the compressor (13), condensed in the outdoor heat exchanger (22), decompressed in the electric expansion valve (15) to undergo expansion, and flows through the primary side (2*a*) of the R—R heat exchanger (2). In the R—R heat exchanger (2), the primary side refrigerant (C1) exchanges heat with the secondary side refrigerant (C2), in consequence of which the primary side refrigerant (C1) is vaporized. Thereafter, the primary side refrigerant (C1) passes through the primary side (2*a*) of the R—R heat exchanger (2), passes through the four-way selector valve (14), and returns to the compressor (13). The primary side refrigerant (C1) is compressed again in the compressor (13) and discharged therefrom to repeat the circulation cycle.

Meanwhile, in the secondary refrigerant circuit (20) the secondary side refrigerant (C2) in the R—R heat exchanger (2) is cooled by the primary side refrigerant (C1). As a result, the secondary side (2*b*) of the R—R heat exchanger (2) undergoes a drop in refrigerant pressure and the refrigerant pressure of the indoor heat exchanger (22) becomes greater than that of the R—R heat exchanger (2). The resulting difference in refrigerant pressure created between the heat exchangers (22) and (2) serves as driving force, and as shown by the chain-line arrows of FIG. 3, the liquid refrigerant in the indoor heat exchanger (22) is withdrawn through the liquid conduit (42) to the secondary side (2*b*) of the R—R heat exchanger (2).

After the refrigerant withdrawal operation, the primary and secondary refrigerant circuits (10) and (20) each switch to the refrigerant supply operation. In other words, the four-way selector valve (14) is switched such that the primary side refrigerant (C1) flows in the direction as indicated by the broken-line arrows and the opening of the electric expansion valve (15) is adjusted to a specified opening degree, in the primary refrigerant circuit (10). On the other hand, in the secondary refrigerant circuit (20) the first electromagnetic valve (43) is open and the second electromagnetic valve (44) is closed.

In such a situation, the supply operation is carried out. In other words, in the primary refrigerant circuit (10), as shown by the broken-line arrows of FIG. 3, the primary side refrigerant (C1), which is a high-temperature, high-pressure gas refrigerant, is discharged from the compressor (13), condensed in the R—R heat exchanger (2), and decompressed in the electric expansion valve (15) to expand. Thereafter, the primary side refrigerant (C1) is vaporized in the outdoor heat exchanger (12), passes through the four-way selector valve (14), and returns to the compressor (13) to repeat the circulation cycle.

Meanwhile, in the secondary refrigerant circuit (20) the secondary side refrigerant (C2) in the R—R heat exchanger (2) exchanges heat with the primary side refrigerant (C1), in consequence of which the secondary side refrigerant (C2) is vaporized. Because of this, the secondary side (2*b*) of the R—R heat exchanger (2) undergoes an increase in refrigerant pressure and the refrigerant pressure of the R—R heat exchanger (2) becomes greater than that of the indoor heat exchanger (22). The resulting difference in refrigerant pressure created between the R—R heat exchanger (2) and the indoor heat exchanger (22) serves as driving force, and as shown by the two-dot chain-line arrows of FIG. 3, the secondary side refrigerant (C2), which is in the gas phase in the R—R heat exchanger (2), passes through the gas conduit (41) from the upper portion of the R—R heat exchanger (2) and is supplied to the indoor heat exchanger (22). In the indoor heat exchanger (22), the gas-phase secondary side refrigerant (C2) exchanges heat with room air and is condenses. As a result, the room air is heated.

The supply operation and the withdrawal operation are carried out alternately so that the secondary side refrigerant (C2) circulates in the secondary refrigerant circuit (20) and the room is heated.

EFFECTS

As described above, the air conditioning system (6) of the second embodiment achieves the same effects that the air conditioning system (5) of the first embodiment does.

In accordance with the air conditioning system (6) of the second embodiment, it is possible to make the secondary side refrigerant (C2) circulate, without having to provide any mechanical driving source such as a pump to the secondary refrigerant circuit (20). This makes it possible to provide a reduction in the electric power consumption. The air conditioning system (6) of the second embodiment is therefore energy saving.

Both the number of factors that may cause a system failure and the number of components that may fail to operate normally can be decreased. The entire system reliability can be improved.

High and low pressures are created in the secondary side refrigerant (C2). The limits of system installation location becomes less strict, thereby achieving high system reliability and flexibility.

The endoergic and heat radiating operations of the secondary refrigerant circuit (20) are performed in stable manner. Even when the secondary refrigerant circuit (20) is very large in size, refrigerant circulation can be carried out sufficiently. Even for the case of large-scale existing piping, desired performance can be obtained.

The primary refrigerant circuit (10) shares the heat carrying apparatus (M) for the secondary side refrigerant (C2), thereby achieving a simplified structure.

THIRD EMBODIMENT

A third embodiment of the present invention is described. An air conditioning system, formed in accordance with the third embodiment of the present invention, is similar to the air conditioning system (5) of the first embodiment or to the air conditioning system (6) of the second embodiment in which the secondary refrigerant circuit (20) is filled with an R407C refrigerant and the primary refrigerant circuit (10) is filled with an HFC-family refrigerant such as an R410A refrigerant.

Except for the above, the air conditioning system of the third embodiment is identical in structure and operation with each of the air conditioning systems (5) and (6).

Accordingly, the air conditioning system of the third embodiment can provide the same effects as achieved by the air conditioning system (5) or by the air conditioning system (6).

Further, in accordance with the air conditioning system of the third embodiment, the primary refrigerant circuit (10) and the secondary refrigerant circuit (20) use different refrigerants (as mentioned above, the former circuit uses an R410A refrigerant as a primary side refrigerant and the latter circuit uses an R407C refrigerant as a secondary side refrigerant). This makes it possible to select a secondary side refrigerant for the secondary refrigerant circuit (20) according to the indoor air conditioning load. Since the secondary refrigerant circuit (20) uses an R407C refrigerant as a secondary side refrigerant, the strength of the secondary line (21) is sufficient enough not to be damaged.

FOURTH EMBODIMENT

Figure 4:
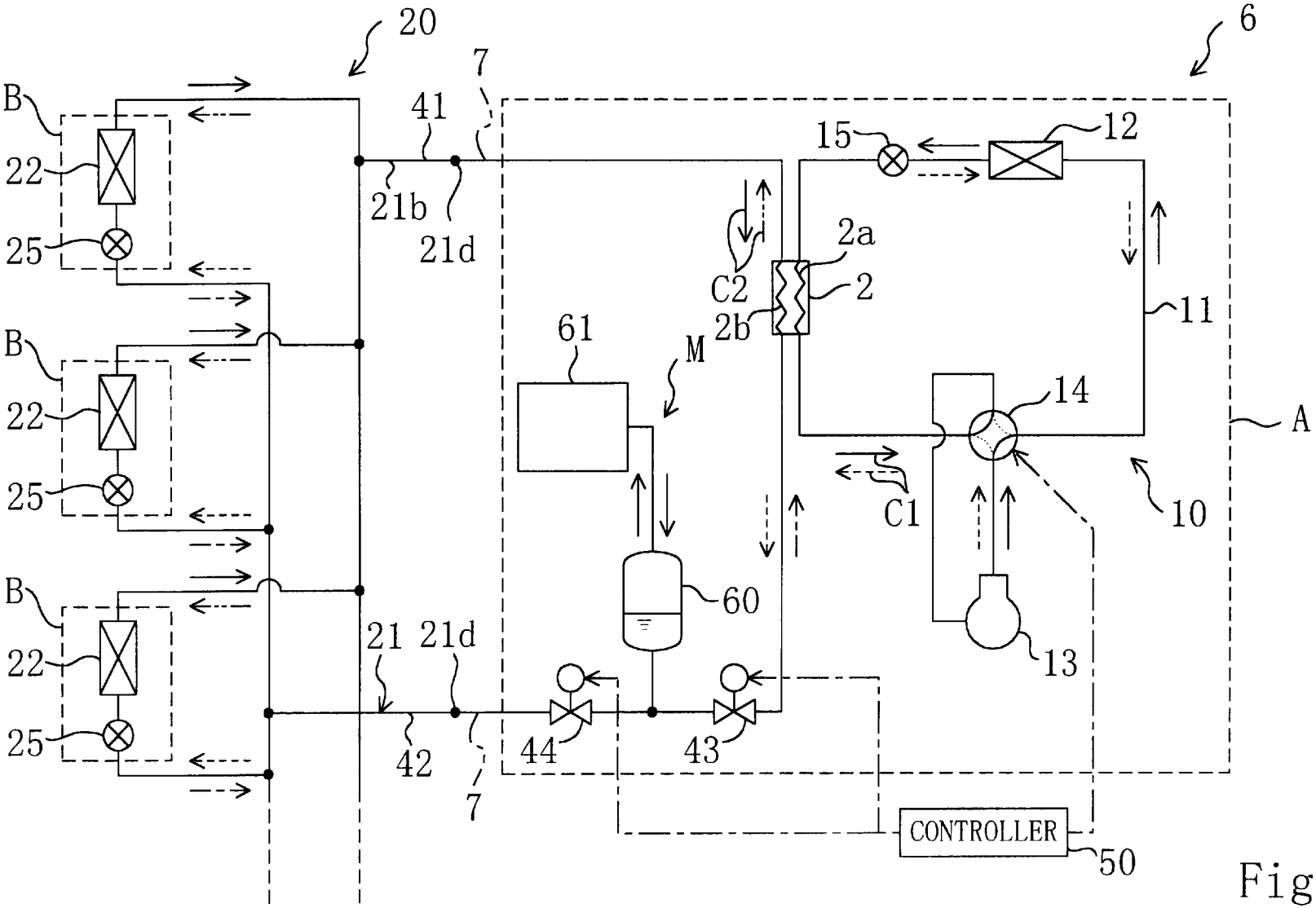
FIG. 4 is a refrigerant circuit diagram of an air conditioning system in accordance with a fourth embodiment of the present invention.

Referring to FIG. 4, therein shown is an air conditioning system (6) according to a fourth embodiment of the present invention. As can be seen from FIG. 4, in the air conditioning system (6) of the fourth embodiment the heat carrying unit (M) of the second embodiment is constructed separately from the primary refrigerant circuit (10). In other words, the secondary side (2*b*) of the R—R heat exchanger (2) in the second embodiment is constructed such that the secondary side refrigerant (C2) is condensed and vaporized, as in the first embodiment.

STRUCTURE

The primary refrigerant circuit (10) of the fourth embodiment is identical in structure with the counterpart of the air conditioning system (6) of the second embodiment. Like elements have therefore been assigned like reference numerals and the description of the elements is omitted.

The heat carrying unit (M) is incorporated into the outdoor unit (A) and comprises a tank (60) and a compression and decompression (C/D) mechanism (61). The tank (60) is constructed so as to hold the secondary side refrigerant (C2) in the liquid phase. Extending from the bottom of the tank (60) is a connection line which is coupled to the liquid conduit (42) of the secondary refrigerant circuit (20) in the outdoor unit (A). The first and second electromagnetic valves (43) and (44) are disposed face-to-face with respect to a point in the liquid conduit (42) at which the connection with the tank (60) is established.

The C/D mechanism (61) is constructed such that (i) the secondary side refrigerant (C2) in the gas phase is cooled and condensed in the tank (60) to create a low pressure, (ii) the secondary side refrigerant (C2) in the liquid phase is heated and vaporized in the tank (60), and (iii) the secondary side refrigerant (C2) is made to circulate by the low and high pressures thus created.

The C/D mechanism (61) is implemented by a vapour compression refrigerating cycle reversible in refrigerant circulation direction. In other words, a compressor, a four-way selector valve, a heat source side heat exchanger, an expansion mechanism, and a use side heat exchanger are sequentially connected together so as to form the C/D mechanism (61). The use side heat exchanger is formed so as to cool or heat the secondary side refrigerant (C2).

MANUFACTURING METHOD

The air conditioning system (6) in accordance with the fourth embodiment and the air conditioning system of the second embodiment are built in the same way. The heat source side circuit (30) of the existing air conditioning system (36) is removed. The outdoor unit (A) having components including the tank (60) is installed. Thereafter, the reuse circuit (20A) of the existing air conditioning system (36) is connected to the outdoor unit (A) using the gas conduit (41) and the liquid conduit (42).

OPERATION

The operations of the air conditioning system (6) of the fourth embodiment are now described below.

COOLING

In the first place, the cooling operation of the air conditioning system (6) is described. The primary refrigerant circuit (10) operates in the same way that the counterpart of the first embodiment does. As shown by the solid-line arrows of FIG. 4, the primary side refrigerant (C1) is discharged out of the compressor (13), condensed in the outdoor heat exchanger (12), vaporized at the primary side (2*a*) of the R—R heat exchanger (2), and brought back to the compressor (13) to repeat the circulation cycle.

In the secondary refrigerant circuit (20) the first electromagnetic valve (43) is open and the second electromagnetic valve (44) is closed. In such a situation, a part of the secondary side refrigerant (C2) held in the tank (60) is condensed by cooling by the C/D mechanism (61).

As a result, the internal pressure of the tank (60) decreases and the refrigerant pressure of the indoor heat exchanger (22) becomes greater than that of the tank (60). The resulting difference in refrigerant pressure created between the indoor heat exchanger (22) and the tank (60) serves as driving force, and as shown by the solid- and broken-line arrows of FIG. 4, the secondary side refrigerant (C2), which is the gas phase in the indoor heat exchanger (22), is withdrawn to the tank (60) through the secondary side (2*b*) of the R—R heat exchanger (2), at which time at the secondary side (2*b*) of the R—R heat exchanger (2), the secondary side refrigerant (C2) in the gas phase is cooled by the primary side refrigerant (C1) to condense. The secondary side refrigerant (C2) becomes a liquid refrigerant which is then held in the tank (60).

Thereafter, there is made a switch from the withdrawal operation to the supply operation. In the primary refrigerant circuit (10) the foregoing operations are continued, and in the secondary refrigerant circuit (20), the first electromagnetic valve (43) is closed and the second electromagnetic valve (44) is open.

In such a situation, a part of the secondary side refrigerant (C2) in the tank (60) is heated by the C/D mechanism (61), in consequence of which the part (C2) is vaporized. The internal pressure of the tank (60) increases and the refrigerant pressure of the tank (60) exceeds that of the indoor heat exchanger (22). The resulting refrigerant pressure difference between the tank (60) and the indoor heat exchanger (22) serves as driving force, and as shown in the broken-line arrows of FIG. 4, the secondary side refrigerant (C2) in the tank (60) in the liquid phase is forced towards the indoor heat exchanger (22). Passing through the flow regulating valve (25), the liquid-phase secondary side refrigerant (C2) flows in the indoor heat exchanger (22). In the indoor heat exchanger (22), the secondary side refrigerant (C2) exchanges heat with room air and is vaporized, thereby cooling the room air.

As described above, the withdrawal and supply operations are carried out alternately, as a result of which the secondary side refrigerant (C2) is made to circulate in the secondary refrigerant circuit (20) for cooling the room.

HEATING

The heating operation is now described. The primary refrigerant circuit (10) of the present embodiment operates in the same way that the counterpart of the first embodiment does. As shown by the broken-line arrows of FIG. 4, the primary side refrigerant (C1) is discharged from the compressor (13), condensed at the primary side (2*a*) of the R—R heat exchanger (2), vaporized in the outdoor heat exchanger (12), and brought back to the compressor (13) to repeat the foregoing circulation cycle.

In the secondary refrigerant circuit (20), the first electromagnetic valve (43) is closed and the second electromagnetic valve (44) is open. In such a situation, a part of the secondary side refrigerant (C2) held in the tank (60) is condensed by cooling by the C/D mechanism (61). As a result, the internal pressure of the tank (60) decreases and the refrigerant pressure of the indoor heat exchanger (22) becomes greater than the refrigerant pressure of the tank (60). The resulting refrigerant pressure difference created between the indoor heat exchanger (22) and the tank (60) serves as driving force, and as shown in the chain-line arrows of FIG. 4, the secondary side refrigerant (C2) in the indoor heat exchanger (22) in the liquid phase is withdrawn to the tank (60).

There is made a switch from the withdrawal operation to the supply operation. In the primary refrigerant circuit (10) the foregoing operation continues, and in the secondary refrigerant circuit (20), the first electromagnetic valve (43) is open and the second electromagnetic valve (44) is closed.

In such a situation, a part of the secondary side refrigerant (C2) in the tank (60) is heated by the C/D mechanism (61), in consequence of which the secondary side refrigerant (C2) is vaporized. The internal pressure of the tank (60) increases and the refrigerant pressure of the tank (60) becomes greater than that of the indoor heat exchanger (22). The resulting refrigerant pressure difference produced between the tank (60) and the indoor heat exchanger (22) serves as driving force, and as shown in the chain-line arrows and the two-dot chain-line arrows of FIG. 4, the secondary side refrigerant (C2) in the tank (60) in the liquid phase passes through the secondary side (2*b*) of the R—R heat exchanger (2) and is supplied to the indoor heat exchanger (22) through the gas conduit (41), at which time at the secondary side (2*b*) of the R—R heat exchanger (2), the liquid-phase secondary side refrigerant (C2) is heated by the primary side refrigerant (C1) to become a gas refrigerant. The gas-phase secondary side refrigerant (C2) supplied to the indoor heat exchanger (22) exchanges heat with room air and is condensed, thereby heating the room air.

As described above, the refrigerant withdrawal and supply operations are carried out alternately, as a result of which the secondary side refrigerant (C2) is made to circulate in the secondary refrigerant circuit (20) for heating the room.

EFFECTS

As described above, the air conditioning system (6) in accordance with the fourth embodiment achieves the same effects that the air conditioning system (5) in accordance with the second embodiment does.

In the air conditioning system (6) in accordance with the fourth embodiment, the heat carrying unit (M) is formed separately from the primary refrigerant circuit (10). This ensures the circulation of the secondary side refrigerant (C2).

OTHER EMBODIMENTS

In each of the air conditioning systems (5) and (6) according to the first to fourth embodiments of the present invention, not only the refrigerant line (21*b*) but also the indoor units (B) are reused. A variation can be made in which only the existing refrigerant line (21*b*) is reused serving as the secondary line (21) and the existing indoor units (B) are replaced by new R407C indoor units (B).

The above is described. The outdoor unit (D) and the indoor units (B) are removed from the existing air conditioning system (36). One end of the remaining part of the existing refrigerant line (21*b*) is connected to the new outdoor unit (A) and the other end is connected to the new indoor units (B).

In such a case, it is possible to effectively use the existing line. Additionally, it is possible to install an indoor unit with a capacity suitable for a refrigerant such as an HFC-family refrigerant and heat load applied.

The existing refrigeration apparatus includes, other than the air conditioning system (36) of FIG. 2, one that has an expansion mechanism only in the outdoor unit and one that has an expansion mechanism only in each indoor unit.

In each of the air conditioning systems (5) and (6) according to the first to fourth embodiments of the present invention, an R407C refrigerant is used in the primary and secondary refrigerant circuits (10) and (20). However, another HFC-family refrigerant such as R410A, an HC-family refrigerant, and an FC-family refrigerant can be used.

In each of the air conditioning systems (5) and (6) according to the first, second and fourth embodiments of the present invention, the primary and secondary refrigerant circuits (10) and (20) can use different refrigerants.

In each of the air conditioning systems (5) and (6) according to the first to fourth embodiments of the present invention, an exchange of heat between the primary side refrigerant (C1) and the secondary side refrigerant (C2) is directly carried out through the R—R heat exchanger (2). However, such a heat exchange between the primary and secondary refrigerants (C1) and (C2) can be indirectly carried out through heat medium such as water and brine.

The present invention is particularly advantageous when the existing line (21*b*) is reused as the secondary line (21), as in the air conditioning systems (5) and (6) according to the first to fourth embodiments of the present invention.

It is to be noted that the present invention is not limited to the above. Both the primary line (11) and the secondary line (21) can be newly installed.

In the above case, the design pressure of the secondary line (21) can be made lower than that of the primary line (11). In other words, the pressure resistance strength of the secondary line (21) can be made smaller than that of the primary line (11). Making the allowable pressure of the secondary line (21) smaller than that of the primary line (11) can reduce the thickness of the secondary line (21), thereby achieving a reduction in the material cost.

One embodiment of the present invention can be a refrigeration apparatus that is formed of the outdoor unit (heat source side unit) (A) only. As shown in FIGS. 1, 3, and 4, such a refrigeration apparatus has the R—R heat exchanger (2) and the primary refrigerant circuit (10), and connection means (7) for connecting together the R—R heat exchanger (2) and the indoor heat exchanger (22) to constitute the secondary refrigerant circuit (20) is disposed in the R—R heat exchanger (2).

As shown in FIGS. 1, 3, and 4, the connecting means (7) constitutes part of the secondary line (21) and is formed of an outer end portion of the refrigerant line (21*a*) extending from the outdoor unit (A). With the connection means (7) connected at the cutting position (21*d*) to the reuse circuit (20A), the refrigeration apparatus constitutes one of the air conditioning systems (5) and (6) manufactured in accordance with the first to fourth embodiments of the present invention.

The air conditioning system (5) of the first embodiment of the present invention is provided with the refrigerant pump (23). Instead of using the refrigerant pump (23), an oilless compressor which requires no refrigeration oil can be employed.

The C/D mechanism (61) in the heat carrying unit (M) of the fourth embodiment is implemented by an independent refrigeration cycle. However, other various heat sources can be utilized. For example, boiler waste heat, and the heat and cold of the primary refrigerant circuit (10) can be utilized.

INDUSTRIAL APPLICABILITY

The refrigeration apparatus and methods for manufacturing the same in accordance with the present invention find applications in the field of air conditioning systems suitable for large-scale buildings, particularly for cases where the existing lines are reused.

What is claimed is:

1. A refrigeration apparatus comprising:

(a) a primary refrigerant circuit (10) which is formed of a combination of a compressor (13), a heat source side heat exchanger (12), decompression means (15), and a primary side (2*a*) of a refrigerant-refrigerant (R—R) heat exchanger (2) that are connected together by a primary line (11), said primary refrigerant circuit (10) being charged with a primary side refrigerant;

(b) a secondary refrigerant circuit (20) which is formed of a combination of a secondary side (2*b*) of said R—R heat exchanger (2) and a use side heat exchanger (22) that are connected together by a secondary line (21), said secondary refrigerant circuit (20) being charged with a secondary side refrigerant of the same type of said primary side refrigerant; and (c) refrigerant carrying means (M) for circulating said second side refrigerant through said secondary refrigerant circuit (20), wherein said primary line (11) is greater in allowable pressure than said secondary line (21).

2. A refrigeration apparatus comprising:

(a) a primary refrigerant circuit (10) which is formed of a combination of a compressor (13), a heat source side heat exchanger (12), decompression means (15), and a primary side (2*a*) of a refrigerant-refrigerant (R—R) heat exchanger (2) that are connected together by a primary line (11), said primary refrigerant circuit (10) being charged with a primary side refrigerant;

(b) connection means (7) for forming a secondary refrigerant circuit (20) by including a part of a secondary line (21) of said secondary refrigerant circuit (20);

said secondary refrigerant circuit (20) being connected to a secondary side (2*b*) of said R—R heat exchanger (2);

said secondary refrigerant circuit (20) being formed of a combination of said secondary side (2*b*) and a use side heat exchanger (22) that are connected together by said secondary line (21);

said secondary refrigerant circuit (20) being charged with a secondary side refrigerant of the same type as said primary side refrigerant; and (c) refrigerant carrying means (M) for circulating said secondary side refrigerant through said secondary refrigerant circuit (20), wherein said primary line (11) is greater in allowable pressure than said secondary line (21).

3. A method of manufacturing a refrigeration apparatus comprising the steps of:

(a) removing the old refrigerant from an existing refrigerant circuit formed of a combination of a compressor (33), a heat source side heat exchanger (31), decompression means (35), and a use side heat exchanger (22) that are connected together by a refrigerant lines (21*a*) and (21*b*);

(b) removing said compressor (33) and said heat exchanger (31) from said existing refrigerant circuit;

(c) linking to a remaining part (20A) of said existing refrigerant circuit a secondary side (2*b*) of a refrigerant-refrigerant (R—R) heat exchanger (2) in a primary refrigerant circuit (10) which is prepared by connecting together a compressor (13), a heat source side heat exchanger (12), said decompressor (35), and a primary side (2*a*) of said R—R heat exchanger (2) by a primary line (11) and being charged with a primary side refrigerant, to form a secondary refrigerant circuit (20) from said secondary side (2*b*) of said R—R heat exchanger (2) and a use side unit (B) and a secondary line (21) lower in allowable pressure than said primary line (11); and (d) charging said secondary refrigerant circuit (20) with a secondary side refrigerant of the same type as said primary side refrigerant.

4. A method of manufacturing a refrigeration apparatus comprising the steps of:

(a) removing the old refrigerant from an existing refrigerant circuit formed of a combination of a heat source side unit (D) and a use said unit (B) that are connected together by an existing refrigerant line (21*b*);

(b) removing said units (D) and (B) from said existing refrigerant circuit, leaving said existing refrigerant line (21*b*) between said units (D) and (B);

(c) linking to one of ends of a remaining part of said existing refrigerant line (21*b*) a secondary side (2*b*) of a refrigerant-refrigerant (R—R) heat exchanger (2) in a primary refrigerant circuit (10) which is prepared by connecting together a compressor (13), a heat source side heat exchanger (12), said decompressor (35), and a primary side (2*a*) of said R—R heat exchanger (2) by a primary line (11) and being charged with a primary side refrigerant, and linking to the other end of said remaining part of said existing refrigerant lien (21*b*) a new use side unit(B), to form a secondary refrigerant circuit (20) from said secondary side (2*b*) of said R—R heat exchanger (2), said new side unit (B), and a secondary side line (21) lower in allowable pressure than said primary side line (11); and (d) charging said secondary refrigerant circuit (20) with a secondary side refrigerant of the same type as said primary side refrigerant.

* * * * *